US007081003B1

(12) United States Patent
Gregori et al.

(10) Patent No.: US 7,081,003 B1
(45) Date of Patent: Jul. 25, 2006

(54) ELECTRICAL CONNECTOR WITH IMPROVED LATCHING SYSTEM

(75) Inventors: Timothy R. Gregori, Lockport, IL (US); Garfield J. Lowe, Bangalore (IN)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 11/093,056

(22) Filed: Mar. 29, 2005

(51) Int. Cl.
*H01R 13/627* (2006.01)

(52) U.S. Cl. ..... 439/352; 439/696

(58) Field of Classification Search ..... 439/352, 439/687, 696, 604, 606
See application file for complete search history.

(56) References Cited

U.S. PATENT DOCUMENTS 4,549,780 A 10/1985 Bertini et al.
5,383,794 A * 1/1995 Davis et al. ..... 439/352
5,435,744 A * 7/1995 Derstine et al. ..... 439/352
5,449,298 A 9/1995 Fetterolf, Sr. et al.
5,558,534 A 9/1996 Sarkady et al.
6,165,017 A * 12/2000 Kuo ..... 439/610
6,450,829 B1 * 9/2002 Weisz-Margulescu ..... 439/352
6,607,397 B1 8/2003 Zhang et al.
6,799,986 B1 10/2004 Igarashi et al.

* cited by examiner

*Primary Examiner*—Tho D. Ta
*Assistant Examiner*—James R. Harvey
(74) *Attorney, Agent, or Firm*—Stephen Z. Weiss

(57) ABSTRACT

An electrical connector is provided with a latching system for latching the connector to a mating connector. The electrical connector includes an interior terminal module having a dielectric body which mounts a plurality of conductive terminals and a pair of latch arms for latching engagement with the mating connector. A pair of hermaphroditic housing halves at least partially surround the terminal module. Each housing half includes a latch actuator engageable with a respective one of the latch arms to move the latch arm out of engagement with the mating connector.

13 Claims, 5 Drawing Sheets

ELECTRICAL CONNECTOR WITH IMPROVED LATCHING SYSTEM

FIELD OF THE INVENTION

This invention generally relates to the art of electrical connectors and, particularly, to a latching system for latching an electrical connector to a mating connecting device.

BACKGROUND OF THE INVENTION

A typical electrical connector includes some form of insulating or dielectric housing which mounts a plurality of conductive terminals. The connector is mated to a complementary mating connector or other connecting device which also has terminals for connection to the terminals of the first connector. Often, there is some form of interengaging latching means between the two connectors to hold the connectors in mated condition.

Flexible latching systems of the prior art require an operator to overcome the spring forces required to maintain the latches, such as latch hooks, of the mating connectors together. Often, a pair of flexible latch arms are provided at opposite sides of one of the connectors. A pair of latch actuators are provided and are separate from the connector housing. Other connectors have latch arms which are not part of the interior terminal module. Still other connectors have a pair of interengaging housing or shell halves which are different from each other and which often are fixed together with screws or other extraneous fastening devices. All of these various latching connectors of the prior art have multiple parts which are expensive and which require excessive manufacturing steps. The present invention is directed to solving these problems by providing a very simple latching system for an electrical connector which is easy and inexpensive to manufacture and assemble.

SUMMARY OF THE INVENTION

An object, therefore, of the invention is to provide an electrical connector with a new and improved latching system for latching the connector to a mating connector.

In the exemplary embodiment of the invention, the connector includes an interior terminal module having a dielectric body which mounts a plurality of conductive terminals and a pair of latch arms for latching engagement with the mating connector. A pair of hermaphroditic housing halves at least partially surround the terminal module. Each housing half includes a latch actuator engageable with a respective one of the latch arms to move the latch arm out of engagement with the mating connector.

According to one aspect of the invention, the latch arms are integral with the hermaphroditic housing halves. In the preferred embodiment of the invention, the housing halves are molded of plastic material and the latch actuators are molded integrally therewith.

According to another aspect of the invention, each hermaphroditic housing half includes a lock arm engageable with a lock shoulder on the other housing half to hold the housing halves together about the interior terminal module. In the preferred embodiment of the invention, each hermaphroditic housing half includes a pair of the lock arms engageable with a complementary pair of lock shoulders on the other housing half. Each housing half is shown herein as being generally rectangular to define four corners, with the pair of lock arms being located at one pair of generally diametrically opposite corners of each housing half engageable with complementary lock shoulders located at another pair of generally diametrically opposite corners of the other housing half.

According to a further aspect of the invention, tongue-and-groove positioning means are provided between the body of the terminal module and the hermaphroditic housing halves to maintain the terminal module in position within the housing halves. In the preferred embodiment, the tongue-and-groove positioning means include a tongue in form of a flange projecting from the body of the terminal module.

A feature of the invention is that the hermaphroditic housing halves have means at rear ends thereof to define a passage for receiving an electrical cable for termination to the terminals of the interior terminal module. The rear ends of the housing halves are substantially closed, except for the passage, whereby a boot can be overmolded about the rear of the connector without the overmolding material of the boot migrating into the interior of the housing halves.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
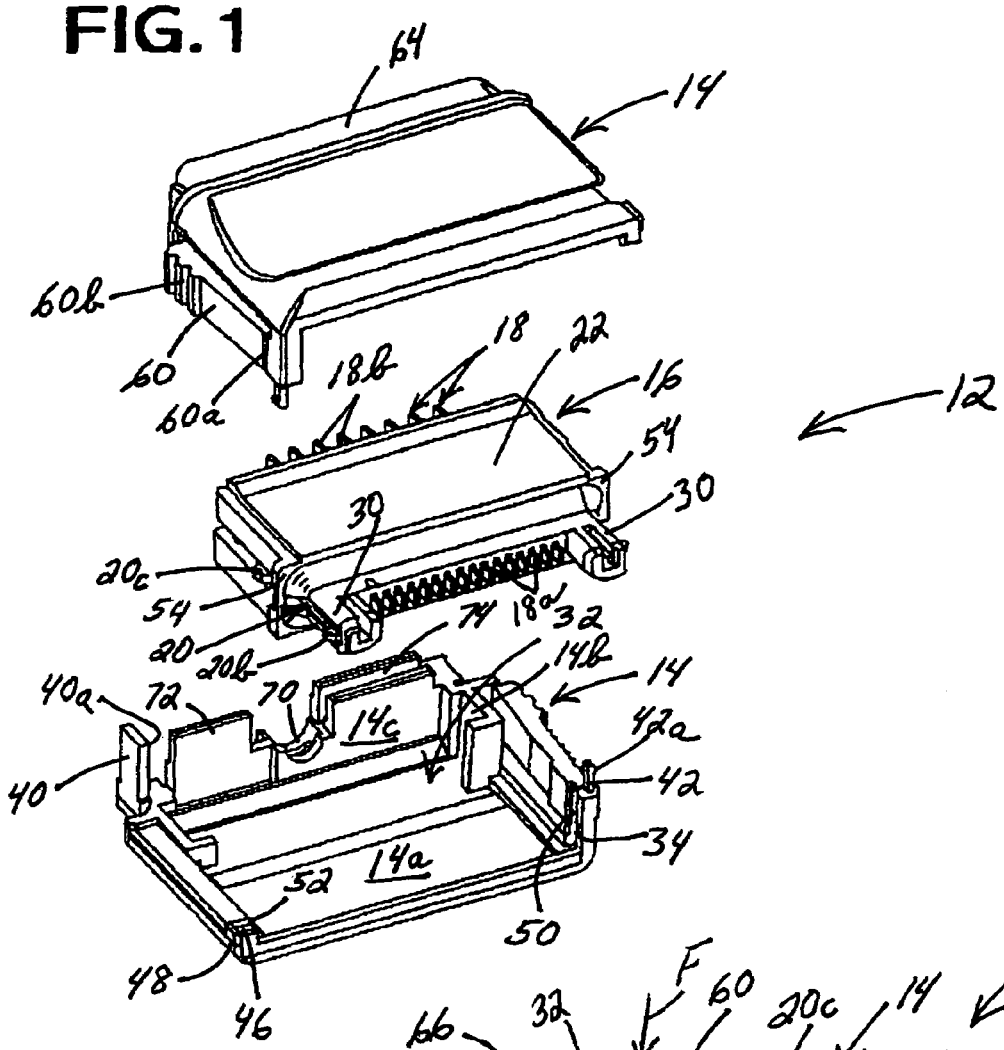
FIG. 1 is a front exploded perspective view of an electrical connector embodying the latching system of the invention.
Figure 2:
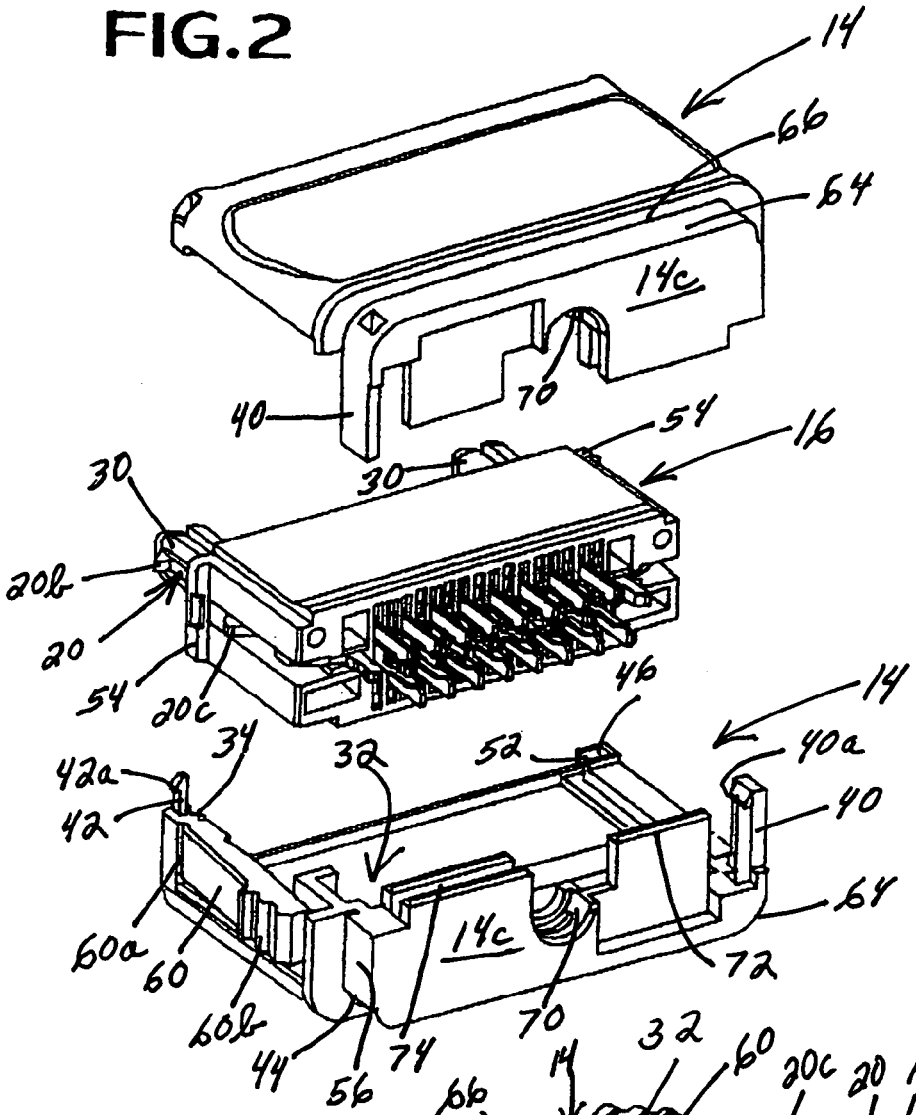
FIG. 2 is a rear exploded perspective view of the connector.

Referring to the drawings in greater detail, and first to FIGS. 1 and 2, the invention is embodied in an electrical connector, generally designated 12, having a latching system for latching the connector to a mating connector or other connecting device (not shown). Connector 12 includes a pair of hermaphroditic (identical) housing halves, generally designated 14, which substantially surround an interior terminal module, generally designated 16. The terminal module mounts a plurality of terminals, generally designated 18, and a pair of flexible latch arms, generally designated 20.

Figure 4:
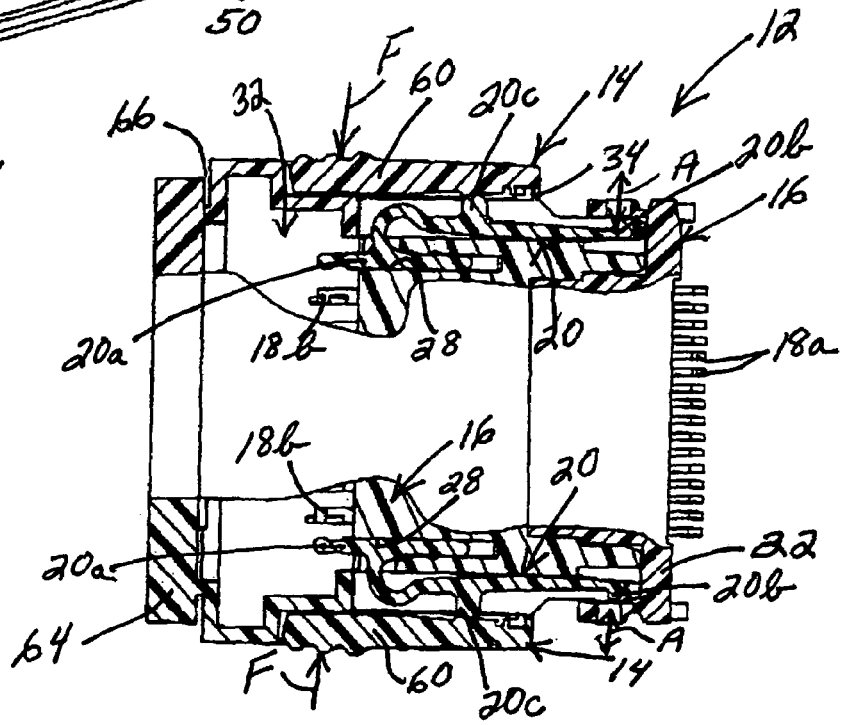
FIG. 4 is a horizontal section through the connector in assembled condition, with the latch actuators in their actuating position.
Figure 3:
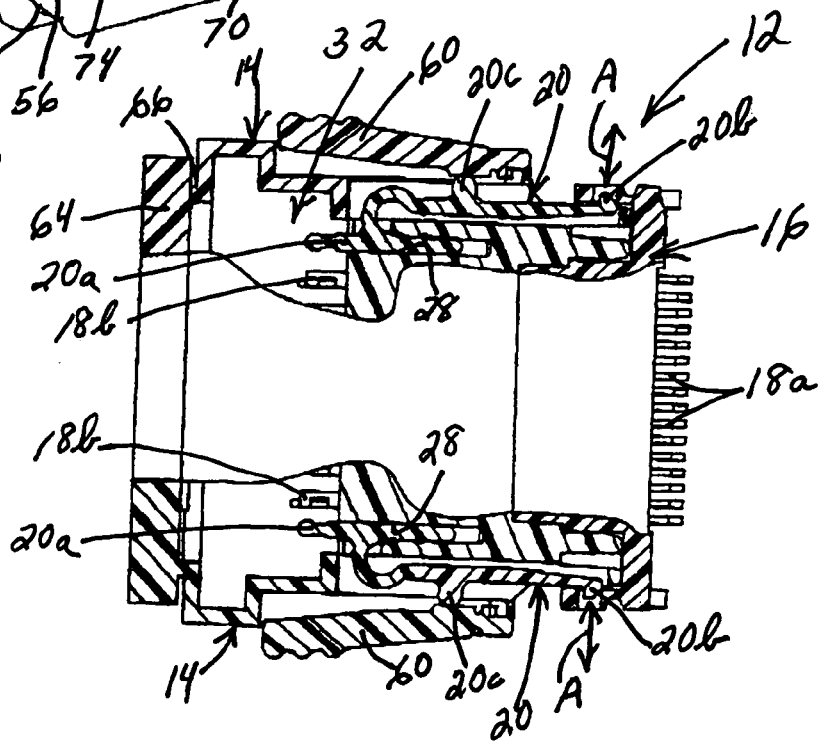
FIG. 3 is a view similar to that of FIG. 3, with the latch actuators in their inoperative position.
Figure 9:
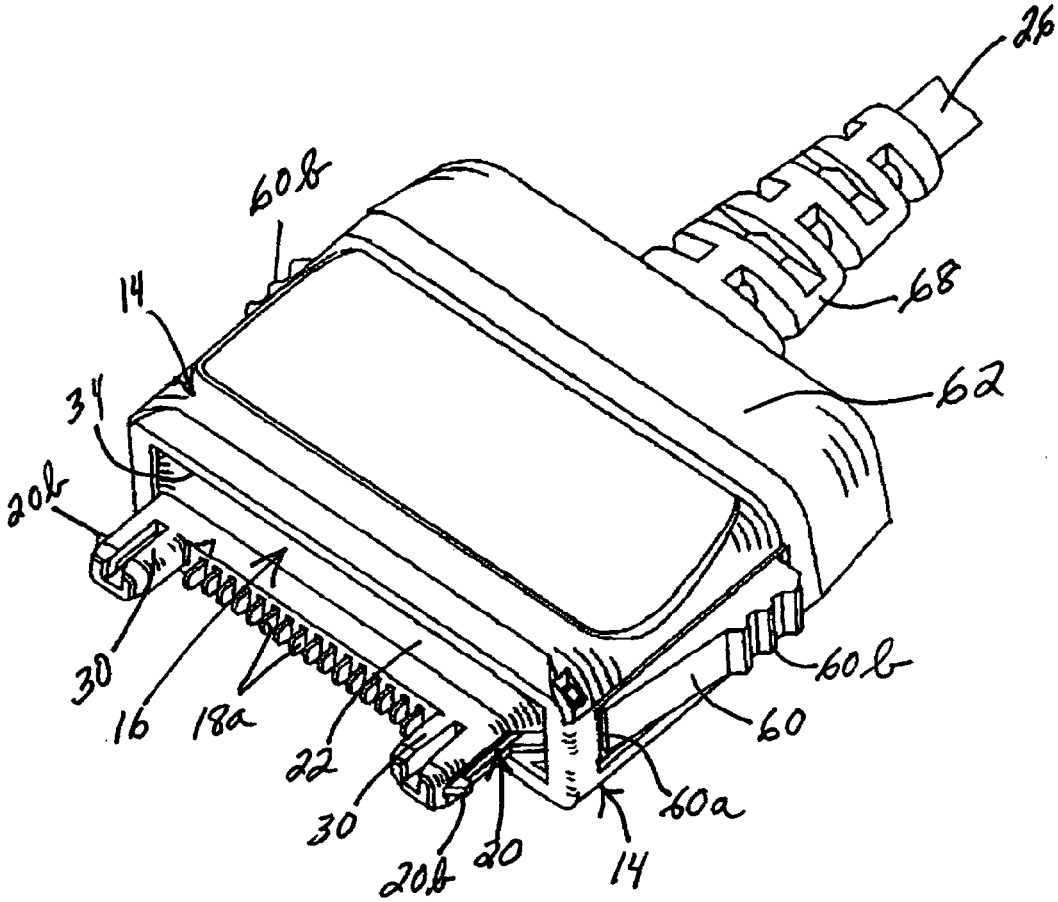
FIG. 9 is a view similar to that of FIG. 7, but with a rear boot overmolded about the rear of the connector and the electrical cable.
Figure 10:
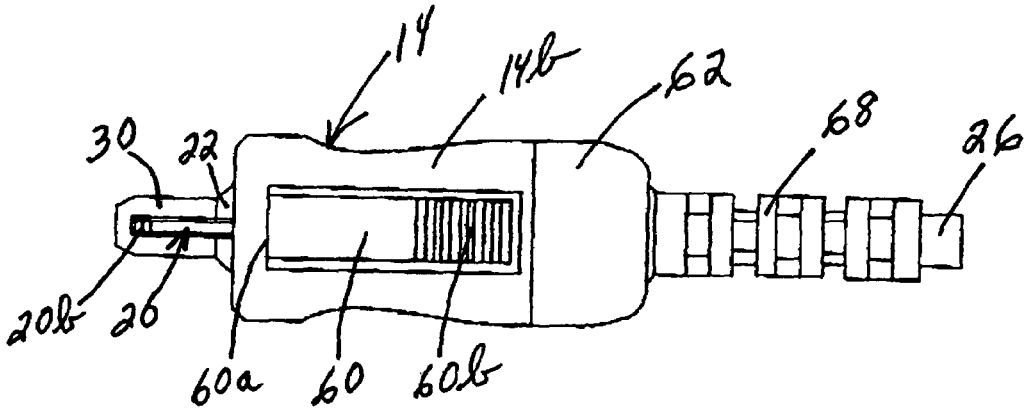
FIG. 10 is a side elevational view of the overmolded connector of FIG. 9.

Referring to FIGS. 3 and 4 in conjunction with FIGS. 1 and 2, interior terminal module 16 includes a dielectric body 22 having a plurality of terminal-receiving passages 24 into which terminals 18 are inserted or "stitched" from the rear of body 22. When terminals 18 are fully mounted into the body, the terminals have front contact portions 18*a* which project out of the front of the body for engaging appropriate contact portions of appropriate terminals on the mating connector. The terminals have terminating portions 18*b* which project out of the rear of the body for connection to appropriate conductors such as the electrical wires of an electrical cable 26 (FIGS. 9 and 10).

FIGS. 3 and 4 show that each latch arm 20 includes a base or fixing portion 20*a*, whereby the respective latch arm can be mounted into body 22 of terminal module 16 from the rear of the body by press-fitting fixing portion 20*a* into a fixing cavity 28 in the body. The latch arm, itself, is cantilevered forwardly of fixing portion 20*a*. Latch arms 20, thereby, are flexible and free to flex inwardly and outwardly in the direction of double-headed arrows "A" (FIGS. 3 and 4). Each latch arm 20 includes an outwardly projecting latch hook 20*b* and an outwardly projecting actuator engaging boss 20*c*. It can be seen that the latch arms are mounted at opposite sides of body 22 of terminal module 16, and latch hooks 20*b* project forwardly into a pair of protective posts 30 which are integral with and project forwardly at opposite sides of body 22. The latch hooks are engageable with appropriate latching shoulders on the mating connector.

Referring back to FIGS. 1 and 2, each hermaphroditic housing half 14 includes a transverse wall 14*a*, a side wall 14*b* and a rear wall 14*c*. When the housing halves are interlocked or closed about terminal module 16, the housing halves define an interior cavity, generally designated 32, which substantially surrounds the terminal module, with a front end of body 22 and protective posts 30 projecting out of a front opening 34 of the interlocked housing halves as seen in FIGS. 3 and 4. When the housing halves are interengaged and locked, cavity 32 is bounded at the top and bottom thereof by transverse walls 14*a* of housing halves 14, by side walls 14*b* of the housing halves and by rear walls 14*c* of the housing halves.

Generally, complementary interengaging lock means are provided between hermaphroditic housing halves 14 to lock the housing halves in interengagement about terminal module 16. Specifically, each hermaphroditic housing half includes a first lock arm 40 having an inwardly directed lock hook 40*a* and a second lock arm 42 having an outwardly directed lock hook 42*a*. Preferably, the housing halves are molded of plastic material and, thereby, lock arms 40 and 42 are flexible. Each hermaphroditic housing half includes a first lock shoulder 44 on the outside thereof, as best seen in FIG. 2, for locking engagement with lock hook 40*a* of the first lock arm 40 of the other housing half. Each hermaphroditic housing half also has a passage 46 which terminates in a second lock shoulder 48, as best seen in FIG. 1, for locking engagement with lock hook 42*a* of the second lock arm 42 of the other housing half.

Each hermaphroditic housing half 14 is generally rectangular in configuration and, thereby, defines four corners. It can be seen in FIGS. 1 and 2 that a pair of lock arms (defined by first lock arm 40 and second lock arm 42) are disposed at diametrically opposite corners of each housing half. Correspondingly, first and second lock shoulders 44 and 48, respectively, are located at the other pair of diametrically opposite corners of each housing half. This provides a solid interengagement between the housing halves to rigidly lock the housing halves together at all four corners of the rectangular configurations thereof.

Generally, tongue-and-groove positioning means are provided between body 22 of terminal module 16 and the hermaphroditic housing halves 14 to maintain the terminal module in position within the interlocked housing halves. Specifically, each hermaphroditic housing half includes a pair of grooves 50 and 52 at opposite sides thereof immediately inside front opening 34. Body 22 of the terminal module has a pair of tongues or flanges 54 projecting outwardly from opposite sides thereof for insertion into grooves 52 and 44 of the housing halves. When the housing halves are interlocked or clamped together, flanges 54 on the terminal module body are clamped within grooves 50 and 52 of the housing halves to maintain the terminal module in position within the housing halves.

Figure 5A:
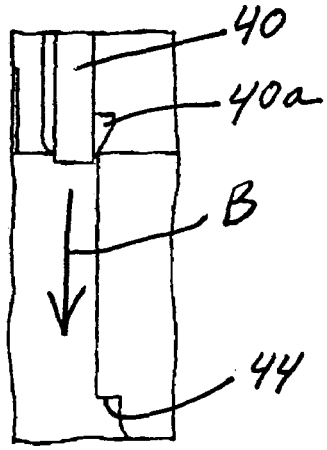
FIGS. 5A–5C are sequential views showing one of the first lock arms moving into locking engagement.
Figure 5B:
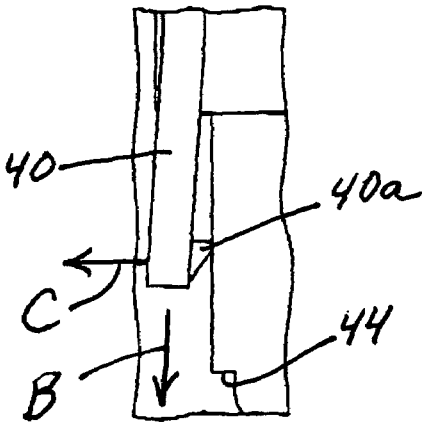
Figure 5C:
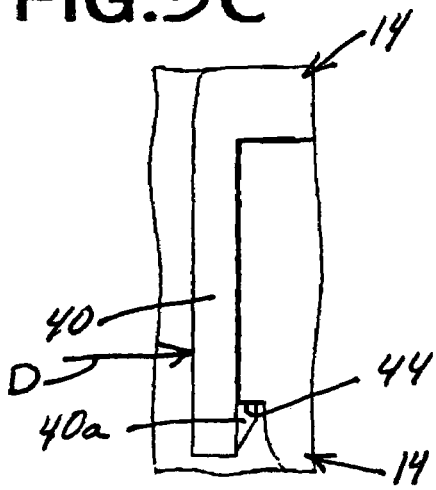

FIGS. 5A–5C show the sequence of interengagement of lock hook 40*a* of first lock arm 40 on one hermaphroditic housing half with the first lock shoulder 44 of the opposite housing half. Specifically, when the housing halves are interengaged, lock hook 40 moves relative to lock shoulder 44 in the direction of arrow "B". As stated above, the housing halves are molded of plastic material, and, thereby, lock arms 40 are flexible. During interengagement of the housing halves, lock arms 40 flex outwardly in the direction of arrow "C" (FIG. 5B) as lock hook 40*a* engages an outside surface 56 of the opposite housing half. When housing halves 14 are fully engaged as shown in FIG. 5C, lock arms 40 "snap" back inwardly in the direction of arrow "D" whereupon lock hooks 40*a* snap into locking engagement with lock shoulders 44.

Figure 6A:
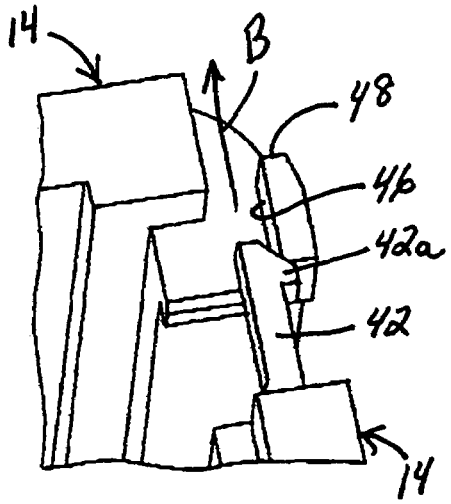
FIGS. 6A–6C are sequential views showing one of the second lock arms moving into latching engagement.
Figure 6B:
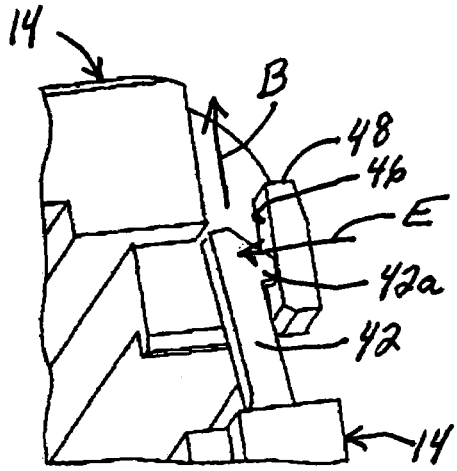
Figure 6C:
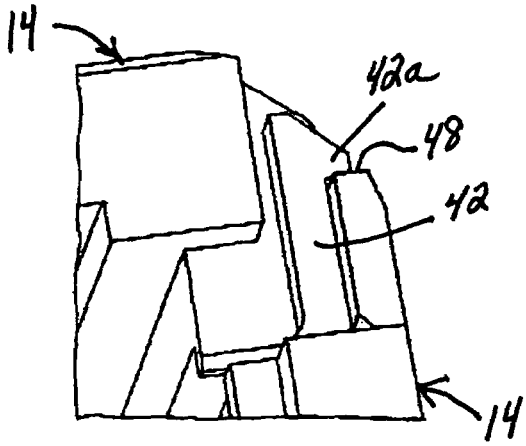

Similarly, second lock arms 42 snap into locking engagement when the two hermaphroditic housing halves 14 are interengaged in the direction of arrow "B" as seen in FIGS. 6A–6C. When lock hooks 42*a* of the second lock arms 42 move into passages 46 of the opposite housing half, lock arms 42 enter passages 46 and flex inwardly in the direction of arrow "E" (FIG. 6B). When the hermaphroditic housing halves are fully engaged as shown in FIG. 6C, lock hooks 42*a* of second lock arms 42 snap back outwardly into engagement with second lock shoulders 48 to hold the housing halves in locked condition about terminal module 16.

Figure 7:
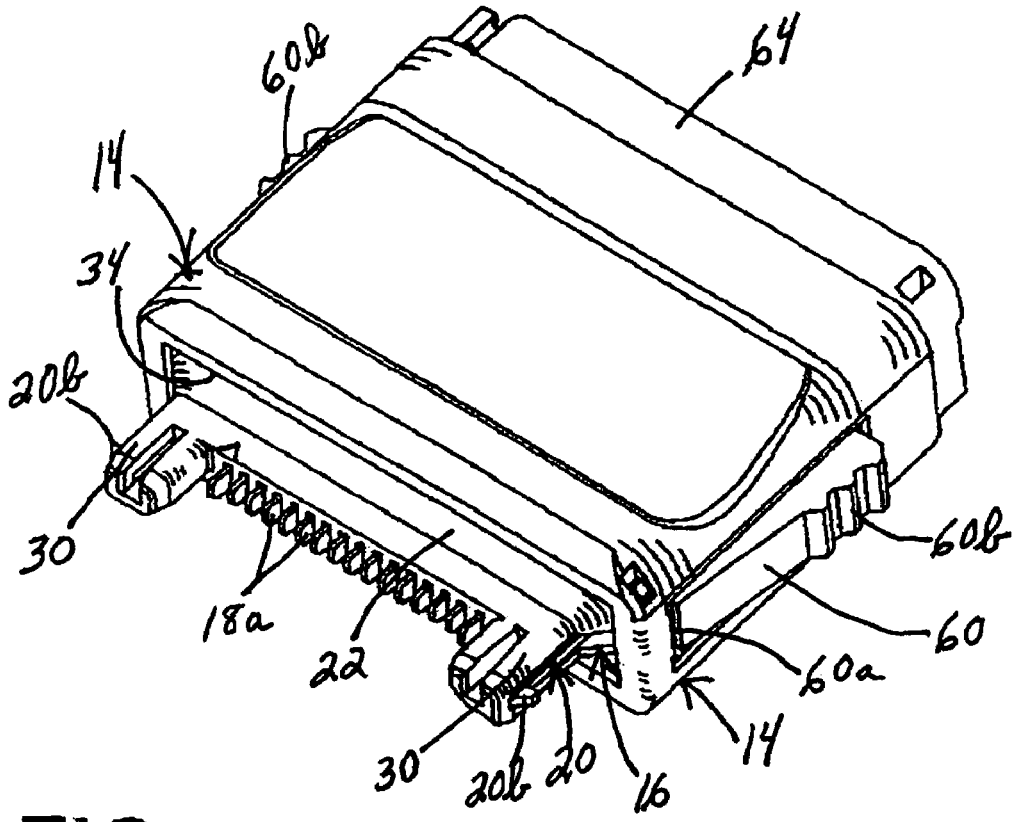
FIG. 7 is a front perspective view of the hermaphroditic housing halves interlocked about the terminal module of the connector.
Figure 8:
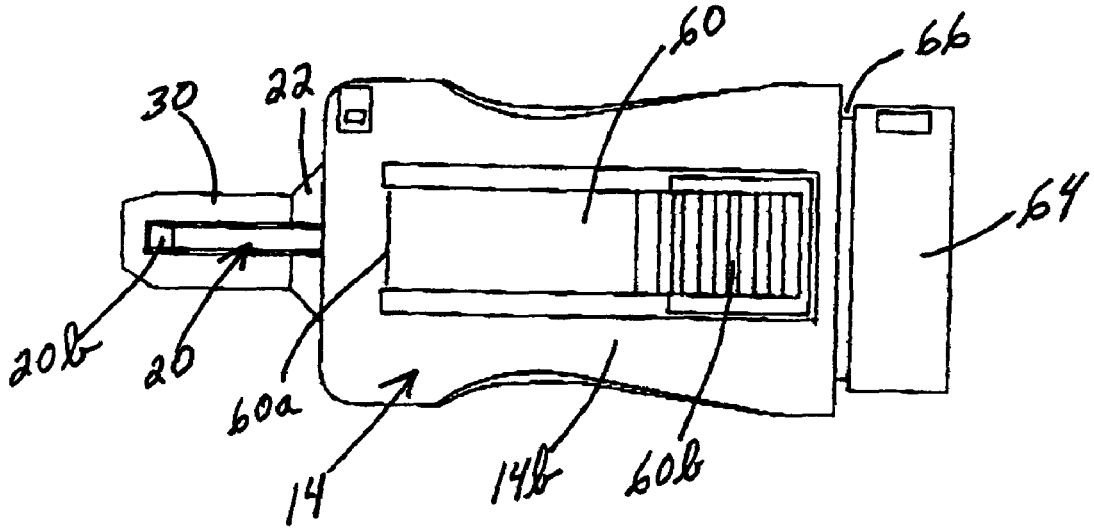
FIG. 8 is a side elevational view of the assembly of FIG. 7.

FIGS. 7 and 8 show the hermaphroditic housing halves 14 in their fully interlocked condition about terminal module 16. It can be seen that the front end of body 22 of the terminal module is exposed within and closes front opening 34 between the housing halves. Protective posts 30 of body 22 project forwardly and protect latch arms 20 while allowing latch hooks 20*b* to project outwardly at opposite sides of the protective posts for engaging the latch means of the mating connector.

Referring back to FIGS. 1 and 2, each hermaphroditic housing half includes a latch actuator 60 at one side thereof whereby, when the housing halves are interengaged, a pair of the latch actuators 60 are located at opposite sides of the connector immediately outside the actuator engaging bosses 20*c* of latch arms 20. Preferably, latch actuators 60 are integral with the housing halves. As stated above, in the preferred embodiment, the housing halves are molded of plastic material. Therefore, latch actuators 60 can be efficiently, integrally molded with the housing halves. As shown, the latch actuators are elongated members cantilevered from a living hinge 60*a* which joins the latch actuators integrally with the housing halves. The distal or free end of each latch actuator has a serrated surface 60*b* on the outside thereof for engagement by a thumb and finger, for instance, of an operator.

FIG. 3 shows the hermaphroditic housing halves 14 interlocked about terminal module 16. It can be seen that latch actuators 60 are located immediately outside and possibly touching the actuator engaging bosses 20*c* of flexible latch arms 20. This is a condition whereat latch hooks 20*b* of the latch arms are in latching engagement with appropriate latch means on the mating connector.

When it is desirable to unlatch connector 12 from the mating connector, latch actuators 60 are pressed inwardly in the direction of arrows "F" as shown in FIG. 4. This will cause latch arms 20 to flex inwardly because of the engagement with the latch actuators with bosses 20*c* of the latch arms. In turn, latch hooks 20*b* at the distal or outer ends of the latch hooks are moved inwardly to unlatch the latch hooks from the latch means of the mating connector. The two connectors now can be easily unmated.

FIGS. 9 and 10 show a rear boot 62 of plastic material overmolded about the rear of the assembly shown in FIGS. 7 and 8. Specifically, hermaphroditic housing halves 14 have reduced-dimensioned rear ends 64, along with a peripheral fixing groove 66. Boot 62 is overmolded about rear ends 64 of the housing halves, with the molded material of the boot being fixed within fixing grooves 66. A flexible boot portion 68 projects rearwardly about electrical cable 26 to provide strain relief for the cable. The cable includes a plurality of conductors or electrical wires which are terminated to terminating portions 18*b* of terminals 18 within terminal module 16.

Generally, the hermaphroditic housing halves 14 are provided with means at rear ends 64 thereof to seal the rear ends of the housing halves to prevent the molten plastic material of overmolded boot 62 from migrating into cavity 32 of the connector. Specifically, it can be seen best in FIG. 2 that rear walls 14*c* of the housing halves have concave portions 70 which, when the housing halves are interlocked, form a passage for receiving electrical cable 26. Preferably, concave portions 70 are sized to fairly snugly grip the cable to provide a seal thereabout. In addition, it can be seen in FIGS. 2 and 3 that rear wall 14*c* of each housing half is divided into a single wall portion 72 at one side of concave portion 70, along with a bifurcated or split wall portion 74 at the opposite side of the concave portion. When the housing halves are interlocked, the single wall portion 72 of one housing half inserts at least slightly into the split wall portion 74 of the other housing half to ensure that the rear walls of the housing halves are sealed against the overmolding material of overmolded boot 62 migrating into the connector.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector having a latching system for latching the connector to a mating connector, comprising:

an interior terminal module including a dielectric body which mounts a plurality of conductive terminals and a pair of latch arms for latching engagement with the mating connector;

a pair of hermaphroditic housing halves, forming an interior cavity, at least partially surrounding the terminal module, and each housing half including a moveable cantilevered latch actuator with an end integral with each housing half engageable with a respective one of said latch arms to move the latch arm out of engagement with the mating connector; and each of the housing halves having means at rear ends thereof for sealing the rear ends of the housing halves to prevent over molding material from migrating into the interior cavity, the means for sealing including a passage, at least one single wall portion on one side of the passage, and at least one split wall portion on an opposite side of the passage, the passage designed to receive there through an electrical cable for termination to the terminals of the terminal module and sized to snugly grip the electrical cable, the at least one single and split wall portions located so that, when the housing halves are interlocked, the single wall portion of each housing half will be inserted into the split wall portion of the interlocked half forming a seal.

2. The electrical connector of claim 1 wherein each hermaphroditic housing half includes a lock arm engageable with a lock shoulder on the other housing half to hold the housing halves together about the terminal module.

3. The electrical connector of claim 2 wherein each hermaphroditic housing half includes a pair of said lock arms engageable with a complementary pair of lock shoulders on the other housing half.

4. The electrical connector of claim 3 wherein each hermaphroditic housing half is generally rectangular to define four corners, with the pair of lock arms being located at one pair of generally diametrically opposite corners of each housing half engageable with complementary lock shoulders located at another pair of generally diametrically opposite corners of the other housing half.

5. The electrical connector of claim 1, including tongue-and-groove positioning means between the body of the terminal module and the hermaphroditic housing halves to maintain the terminal module in position within the housing halves.

6. The electrical connector of claim 5 wherein said tongue-and-groove positioning means comprise a groove in each hermaphroditic housing half for receiving a flange projecting from the body of the terminal module.

7. The electrical connector of claim 1 wherein said latch actuators are joined to the hermaphroditic housing halves by a living hinge.

8. An electrical connector having a latching system for latching the connector to a mating connector, comprising:

an interior terminal module including a dielectric body which mounts a plurality of conductive terminals and a pair of latch arms for latching engagement with the mating connector;

a pair of hermaphroditic housing halves, forming an interior cavity, at least partially surrounding the terminal module, each housing half including a moveable cantilevered latch actuator with an end integral with each housing half engageable with a respective one of said latch arms to move the latch arm out of engagement with the mating connector, an integral lock arm engageable with a lock shoulder on the other housing half to hold the housing halves together about the terminal module;

interengaging positioning means between the body of the terminal module and the hermaphroditic housing halves to maintain the terminal module in position within the housing halves; and each of the housing halves having means at rear ends thereof for sealing the rear ends of the housing halves to prevent over molding material from migrating into the interior cavity, the means for sealing including a passage, at least one single wall portion on one side of the passage, and at least one split wall portion on an opposite side of the passage, the passage designed to receive there through an electrical cable for termination to the terminals of the terminal module and sized to snugly grip the electrical cable, the at least one single and split wall portions located so that when the housing halves are interlocked, the single wall portion of each housing half will be inserted into the split wall portion of the interlocked half forming a seal.

9. The electrical connector of claim 8 wherein each hermaphroditic housing half includes a pair of said lock arms engageable with a complementary pair of lock shoulders on the other housing half.

10. The electrical connector of claim 9 wherein each hermaphroditic housing half is generally rectangular to define four corners, with the pair of lock arms being located at one pair of generally diametrically opposite corners of each housing half engageable with complementary lock shoulders located at another pair of generally diametrically opposite corners of the other housing half.

11. The electrical connector of claim 8 wherein said interengaging positioning means comprises a tongue-and-groove structure.

12. The electrical connector of claim 11 wherein said tongue-and-groove structure comprises a groove in each hermaphroditic housing half for receiving a flange projecting from the body of the terminal module.

13. The electrical connector of claim 8 wherein said hermaphroditic housing halves are molded of plastic material and the latch actuators are joined to the hermaphroditic housing by a living hinge.

* * * * *